US006363914B1

(12) United States Patent
Tanabe et al.

(10) Patent No.: US 6,363,914 B1
(45) Date of Patent: Apr. 2, 2002

(54) ACCUMULATOR FUEL INJECTION SYSTEM

(75) Inventors: Keiki Tanabe, Yokohama; Susumu Kohketsu, Tokyo; Seijiro Kotooka, Yokohama, all of (JP)

(73) Assignee: Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 09/668,668

(22) Filed: Sep. 22, 2000

(30) Foreign Application Priority Data

Sep. 22, 1999 (JP) ..... 11-268412

(51) Int. Cl.[7] ..... F02M 33/04
(52) U.S. Cl. ..... 123/447; 123/514
(58) Field of Search ..... 123/447, 458, 123/514, 467, 506

(56) References Cited

U.S. PATENT DOCUMENTS 5,732,679 A * 3/1998 Takahasi et al. ..... 123/467
6,092,509 A * 7/2000 Tanabe et al. ..... 123/447
6,112,721 A * 9/2000 Kouketsu et al. ..... 123/447
6,192,862 B1 * 2/2001 Tanabe et al. ..... 123/447

FOREIGN PATENT DOCUMENTS

JP 6-346814 12/1994
JP 8-218967 8/1996
WO WO98/09068 3/1998

* cited by examiner

*Primary Examiner*—Thomas N. Moulis
(74) *Attorney, Agent, or Firm*—Rossi & Associates

(57) ABSTRACT

An accumulator fuel injection system for controlling an injection rate according to the operating state of an engine comprises: a first accumulation chamber 2 for containing high-pressure fuel supplied by a fuel supply pump 1; a first electromagnetic valve device 4 provided in a fuel passage 30, which connects the first accumulation chamber 2 with a fuel injection valve 8, the first electromagnetic valve switching the fuel passage 30 between a connected state or a disconnected state; a branch passage 32 branched from the fuel passage 30 at downstream side of the first electromagnetic device 4, the branch passage 32 having sufficiently lower constant fuel pressure than fuel pressure in the first accumulation chamber 2; and a second electromagnetic valve device 9 provided in a fuel return passage 33 connecting the fuel injection valve 8 with a fuel tank 10, the second electromagnetic valve device 9 switching fuel, which is injected from the fuel injection valve 8, between an injected state and an uninjected state; and control means 40 for opening the first electromagnetic valve device 4 prior to the opening of the second electromagnetic valve device 9 and then opening the second electromagnetic valve device 9.

6 Claims, 2 Drawing Sheets

ΔTi : PERIOD FROM OPENING OF SWITCHING VALVE 4 OF OPENING OF OPENING/CLOSING VALVE 9

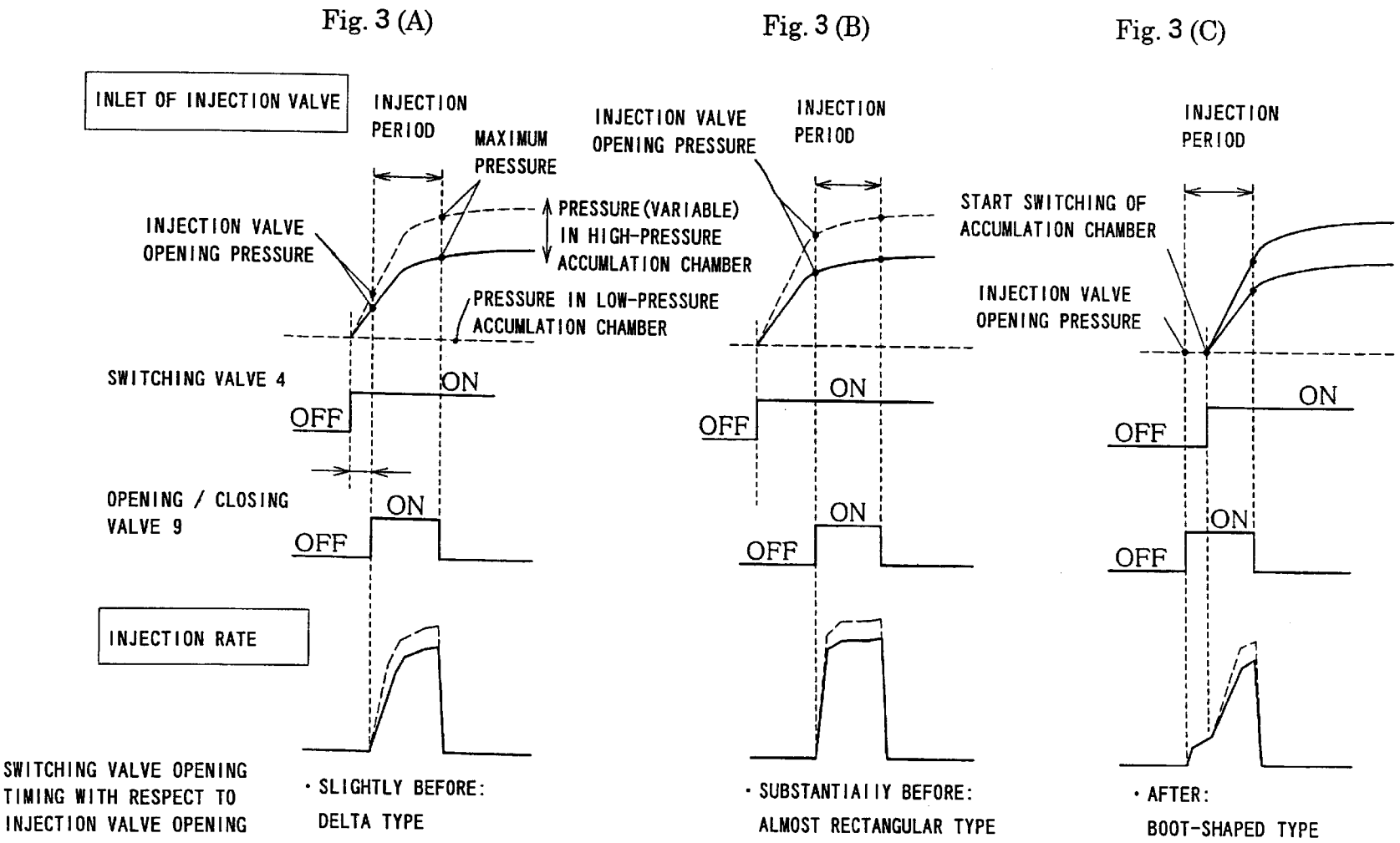
Fig. 3 (A)
INLET OF INJECTION VALVE
INJECTION PERIOD
MAXIMUM PRESSURE
PRESSURE (VARIABLE) IN HIGH-PRESSURE ACCUMLATION CHAMBER
PRESSURE IN LOW-PRESSURE ACCUMLATION CHAMBER
INJECTION VALVE OPENING PRESSURE
SWITCHING VALVE 4
ON
OFF
OPENING / CLOSING VALVE 9
ON
OFF
INJECTION RATE
· SLIGHTLY BEFORE: DELTA TYPE
SWITCHING VALVE OPENING TIMING WITH RESPECT TO INJECTION VALVE OPENING
Fig. 3 (B)
INJECTION PERIOD
INJECTION VALVE OPENING PRESSURE
ON
OFF
ON
OFF
· SUBSTANTIALLY BEFORE: ALMOST RECTANGULAR TYPE
Fig. 3 (C)
INJECTION PERIOD
START SWITCHING OF ACCUMLATION CHAMBER
INJECTION VALVE OPENING PRESSURE
ON
OFF
ON
OFF
· AFTER: BOOT-SHAPED TYPE

ACCUMULATOR FUEL INJECTION SYSTEM

BACKGROUND OF THE INVENTION

1. Field of the Invention

The present invention relates to an accumulator fuel injection system.

2. Description of Related Art

An accumulator fuel injection system (a common rail system) is known for use as a fuel injection system in an internal combustion engine such as a diesel engine. This accumulator fuel injection system supplies high-pressure fuel, which is accumulated in an accumulation chamber, to each cylinder of the engine to thereby improve an engine performance in a wide operating region from a low speed region to a high speed region. If, however, a fuel injection rate is excessively high just after the start of fuel injection, the use of this fuel injection system would result in an abrupt explosive combustion at the initial stage of combustion. This increases an engine noise and nitrogen oxide (NOx) in exhaust gas.

To solve this problem, an accumulator fuel injection system has been proposed which injects fuel at a lower fuel injection rate at the initial stage of each fuel injection cycle than at the intermediate and later stages, and controls the injection rate according to the operating state of the engine.

Such a fuel injection system is disclosed in, for example, Japanese Patent Provisional Publication No. 8-218967. This fuel injection system controls the fuel injection rate in such a manner as to achieve a low fuel injection rate at the initial stage. This fuel injection system has an injection rate (hereinafter referred to as "delta injection rate") at which an injection volume starts increasing gradually just after the start of the fuel injection if the engine is operated at a low speed and with a low load. More specifically, this fuel injection system is constructed in such a manner that a first electromagnetic valve is provided in a fuel passage, which connects a common rail as a high-pressure fuel accumulation chamber with a fuel storage chamber of a fuel injection valve, and that a second electromagnetic valve is provided in a passage, which is branched from the fuel passage and reaches a control chamber. The second electromagnetic valve controls the switching of the fuel injection valve. To inject the fuel at a delta injection rate shown in FIG. 2 of the above-mentioned Publication No. 8-218967, the fuel injection system turns off the second electromagnetic valve to raise the back pressure of the control chamber and turns on the first electromagnetic valve in the state where the fuel injection valve is opened, thus discharging the high-pressure fuel in the fuel passage to the lower pressure side such as the fuel tank.

Then, the fuel injection system turns on the second electromagnetic valve to lower the back pressure of the control chamber and make the fuel injection valve openable, and then turns off the first electromagnetic valve to supply the high-pressure fuel to the fuel passage from a high-pressure accumulation chamber. This gradually raises the inner pressure of the fuel storage chamber of the fuel injection valve from low pressure to high pressure. More specifically, by using a response delay period in the increase in oil pressure in the fuel passage, a nozzle needle is lifted to gradually increase the fuel injection rage in order to achieve the delta injection rate when the inner pressure of the fuel storage chamber exceeds the valve opening pressure of the fuel injection valve.

When the engine is operated at a high speed and with a high load, the injection rate is an injection rate at which the injection amount starts increasing sharply to inject a large amount of fuel in a short period of time just after the start of the fuel injection (hereinafter referred to as "rectangular injection rate"). More specifically this fuel injection system is capable of switching the injection rate between the delta injection rate and the rectangular injection rate according to the operating state of the engine.

International Publication No. WO98/09068 also discloses this kind of fuel injection system. As shown in FIG. 6 of this publication, two accumulation chambers with low pressure and high pressure are provided to execute a pilot injection wherein a low-pressure injection is performed before a high-pressure injection, and an injection wherein a high-pressure injection follows a low-pressure initial injection. In this fuel injection system, a first two-way electromagnetic valve is provided at the downstream side of the high-pressure accumulation chamber and a check valve is provided at the downstream side of the first two-way electromagnetic valve to thereby prevent the change in pressure inside a fuel chamber (fuel storage) of a fuel injection valve and the turbulence of an injection waveform. In this fuel injection system, the high-pressure fuel remaining in the fuel passage after the fuel injection flows into the fuel pressure through the orifice and is regulated to be predetermined pressure by an attached pressure regulator without the necessity of providing an injection pump for the low-pressure accumulation chamber Moreover, in this fuel injection system, the fuel is supplied from the low-pressure accumulation chamber to the fuel passage through a check valve disposed in parallel with the orifice when the fuel pressure in the fuel passage is lowered.

In the former fuel injection system, an injection start timing of the fuel injection valve uses a response delay in the increase in oil pressure in the fuel passage after the second electromagnetic valve is turned on to lower the fuel pressure. Therefore, the injection timing is inaccurate, and there is only a low degree of freedom in the control of the injection rate at the start of the injection since the pressure at the initial stage of the injection is determined according to the injection-valve opening pressure. It is therefore impossible to achieve the optimum fuel injection rate according to the operating state of the engine.

It is therefore impossible to make the best use of the original merits of the accumulator fuel injection system.

The latter fuel injection system is provided with a second electromagnetic valve that controls the injection of fuel from the fuel injection valve. The second two-way electromagnetic valve is opened prior to the opening of the first two-way electromagnetic valve during the pilot injection wherein the low-pressure injection is performed before the high-pressure injection or during the injection wherein the high-pressure injection follows the low-pressure initial injection. During the pilot injection, the second two-way electromagnetic valve is opened for a predetermined period of time and is then closed, and thereafter, the first and second two-way electromagnetic valves are opened at the same time.

Since the pressure at the initial stage of the injection is determined according to the fuel pressure in the low-pressure accumulation chamber in this fuel injection system, there is only a low degree of freedom in the control of the injection rate at the start of the injection. It is therefore impossible to achieve the optimum initial fuel injection rate according to the operating state of the engine.

Accordingly, it is an object of the present invention to provide an accumulator fuel injection system, which is capable of controlling the injection rate according to the operating state of the engine and simplifies the structure.

SUMMARY OF THE INVENTION

To accomplish the above object, high-pressure fuel pressurized by a fuel supply pump is stored in a first accumulation chamber, and is supplied to a fuel injection valve provided in an internal combustion engine through a first electromagnetic valve device and a fuel passage. Further, the high-pressure fuel pressurized by the fuel supply pump is supplied to a branch passage, which is connected with the downstream side of the first electromagnetic valve device in the fuel passage, and is stored at lower constant pressure than fuel pressure in the first accumulation chamber.

The first electromagnetic valve device switches the fuel passage between a connected state and a disconnected state. A second electromagnetic valve device is provided in a fuel return passage connecting the fuel injection valve with a fuel tank, and switches fuel, injected from the fuel injection valve, between an injected state and an uninjected state.

When the fuel is injected, the first electromagnetic valve device is opened prior to the opening of the second electromagnetic valve device. This achieves a delta injection rate and a rectangular injection rate with a high degree of freedom.

In one embodiment of the present invention, a period since the first electromagnetic valve device is opened until the second electromagnetic valve device is opened is controlled according to the operating state of an engine. This controls the injection rate effectively for the decrease in exhaust gas and the improvement of fuel economy.

Moreover, the period is controlled to be short when the engine is operated at a low speed and with a low load, and the period is controlled to be long when the engine is operated at a high speed and with a high load. This acquires the optimum injection rate according to the operating state of the engine.

Furthermore, the fuel supply pump is controlled in such a manner as to make variable fuel pressure in the first accumulation chamber according to the operating state of the engine. This makes variable the injection-valve opening pressure and the maximum injection pressure in the achievement of the delta injection rate and the rectangular injection rage according to the operating state of the engine. The control of the maximum injection pressure according to the operating state of the engine raises the degree of freedom in the control of the injection rate and achieves the optimum fuel injection rate according to the operating state of the engine.

In another mode of the present invention, an orifice and a check valve are arranged in parallel in a branch passage, and the first accumulation chamber and a pressure control valve are also provided in the branch passage. Therefore, just after the opening of the first electromagnetic valve device and the second electromagnetic valve device, the high-pressure fuel in the fuel passage is supplied to a second accumulation chamber through the orifice and is regulated to be lower constant pressure than fuel pressure in the first accumulation chamber. If the second electromagnetic valve device is opened prior to the first electromagnetic valve device or if the fuel pressure in the fuel passage is lower than the fuel pressure in the second accumulation chamber regulated to be the constant pressure, the fuel in the second accumulation chamber is supplied from the branch passage to the fuel passage or to the fuel injection valve via the fuel passage through the check valve.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3 is a view showing examples of the operation of the accumulator fuel injection system in FIG. 1 and injection rate waveforms.

DETAILED DESCRIPTION OF THE PREFERRED EMBODIMENT

A preferred embodiment of the present invention will be described hereinbelow with reference to the accompanying drawings.

Figure 1:
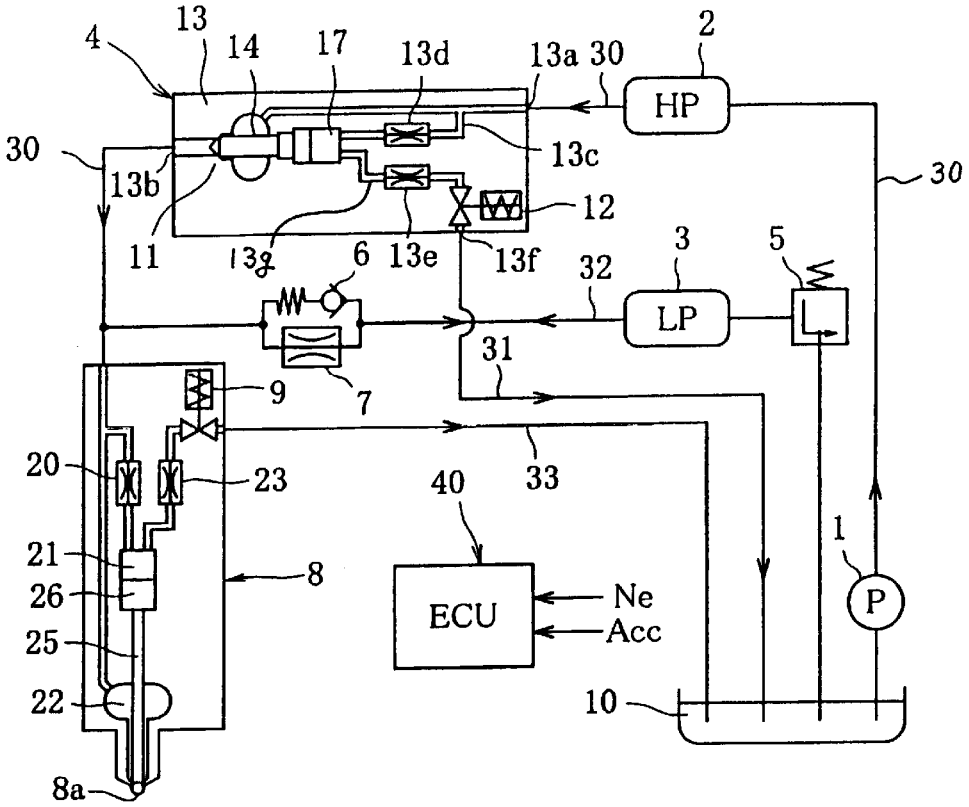
FIG. 1 is a schematic drawing showing an accumulator fuel injection system according to a preferred embodiment of the present invention.

FIG. 1 is a schematic diagram showing the structure of an accumulator fuel injection system according to the preferred embodiment of the present invention.

In FIG. 1, the accumulator fuel injection system is loaded in a diesel engine (not shown) as an internal combustion engine. The accumulator fuel injection system is comprised mainly of a high-pressure fuel pump 1, a high-pressure accumulation chamber (a high-pressure CR) 2, a low-pressure accumulation chamber (a low-pressure CR) 3, a low/high-pressure fuel switching valve (hereinafter referred to as a "switching valve") 4, a pressure control valve 5 for controlling pressure in the low-pressure accumulation chamber 3, a check valve 6, an orifice 7, a fuel injection valve 8, an opening/closing valve 9 for controlling the start and finish timings of the fuel injection by the fuel injection valve 8, a fuel tank 10, and an electronic control unit (ECU) 40 for controlling the switching valve 4 and the opening/closing valve 9.

The high-pressure fuel pump 1 as a fuel supply pump is provided in a fuel passage 30, which extends from the fuel tank 10 to the fuel injection valve 8. The fuel supply pump 1 is run by the engine to charge fuel from the fuel tank 10 and discharge the fuel into the fuel passage 30 at the downstream of the high-pressure fuel pump 1. The electronic control unit 40 controls the high-pressure fuel pump 1 according to an engine speed Ne sensed by an engine speed sensor (not shown) and an accelerator pedal depression amount (accelerator opening) Acc sensed by an accelerator opening sensor (not shown) to adjustably set a pumping stroke of a plunger (not shown) in the high-pressure fuel pump 1. Moreover, the electronic control unit 40 feedback-controls the pumping stroke (fuel supply volume) according to fuel pressure (PHP) sensed by a pressure sensor (not shown) provided in the high-pressure accumulation chamber 2. This achieves high fuel pressure in conformity with the operating state of the engine.

The high-pressure fuel discharged from the high-pressure fuel pump 1 is stored in the high-pressure accumulation chamber 2 provided in the fuel passage 30 at the downstream of the high-pressure fuel pump 1. The high-pressure accumulation chamber 2 as the first accumulation chamber is commonly used for cylinders of the engine, and is connected to the fuel injection valve 8 of each cylinder through the fuel passage 30.

The switching valve 4 as the first electromagnetic device is mounted in the middle of the fuel passage 30 between the high-pressure accumulation chamber 2 and the fuel injection valve 8.

The switching valve 4 is composed of a valve device 11 and an electromagnetic valve 12. A needle valve 14 is contained in a valve holder of the valve device 11. The needle valve 14 is provided between an inlet port 13*a* and an outlet port 13*b*, and connects and disconnects them. The needle valve 14 is forced by a spring (not shown) to close the outlet port 13*b*. The input port 13*a* connects to a pressure control chamber 17 formed at the back face (piston of the needle valve 14) through a fuel control passage 13*c* and an inlet side orifice 13*d*. The pressure control chamber 17 is connected to a fuel leak port 13*f* through a fuel leak passage 13*g*, an outlet side orifice 13*c* and the electromagnetic valve 12.

The inlet port 13*a* of the valve device 11 connects to the high-pressure accumulation chamber 2 through the fuel passage 30, and the outlet port 13*b* of the valve device 11 connects to the fuel injection valve 8 through the fuel passage 30. The fuel leak port 13*f* connects to the fuel tank 10 through the leak fuel passage 31. The electronic control unit 40 controls the electromagnetic valve 12.

The high-pressure fuel in the high-pressure accumulation chamber 2 is supplied to the pressure control chamber 17 through the inlet side orifice 13*d*. When the electromagnetic valve 12 is closed, the high-pressure fuel in the pressure control chamber 17 presses the needle valve 14 down and forces the needle valve 14 in a valve closing direction in corporation with spring force of the spring to thereby disconnect the inlet port 13*a* and the outlet port 13*b*. When the electromagnetic valve 12 is opened, the high-pressure fuel in the pressure control chamber 17 is discharged toward the leak fuel passage 31 from the fuel leak port 13*f* through the outlet side orifice 13*e*. Accordingly, the pressure in the pressure control chamber 17 is lowered, and the needle valve 14 is pressed up and opened against the spring force of the spring. Therefore, the inlet port 13*a* and the outlet port 13*b* are connected with each other. This causes the high-pressure fuel in the high-pressure accumulation chamber 2 to be supplied to a fuel chamber 22 of the fuel injection valve 8.

The fuel leaked from the outlet side orifice 13*e* when the electromagnetic valve 12 is opened is discharged into the fuel tank 10 through the leak fuel passage 30.

The low-pressure accumulation chamber 3, which is common to the cylinders, is connected to the fuel passage 30 through a branch passage 32 that is branched from the fuel passage 30 at the downstream of the switching valve 4. The low-pressure accumulation chamber 3 as the second accumulation chamber contains the fuel with sufficiently lower fuel pressure PLP than the fuel pressure PHP in the high-pressure accumulation chamber 2. The check valve 6 and the orifice 7 are connected in parallel in the middle of the branch passage 32, and the check valve 6 permits the flow of the fuel from the low-pressure accumulation chamber 3 toward the fuel passage 30.

If the fuel pressure in the fuel passage 30 is higher than the fuel pressure in a part closer to the low-pressure accumulation chamber 3 than to the orifice 7, the fuel closer to the low-pressure accumulation chamber 3 flows into the branch passage 32 and further flows into the fuel passage 30.

The pressure control valve 5 for regulating the fuel pressure (PLP) of the low-pressure accumulation chamber 3 is provided between the low-pressure accumulation chamber 3 and the fuel tank 10 in the branch passage 32. The pressure control valve 5 is composed of an automatic valve, e.g., a relief valve, and regulates the fuel pressure in the low-pressure accumulation chamber 3 to predetermined pressure (constant pressure).

The fuel injection valve 8 which is provided in each cylinder of the engine has a pressure control chamber 21 connected thereto through an orifice 20, and a fuel chamber (fuel storage) 22. The pressure control chamber 21 is connected to the fuel tank 10 through an orifice 23 and a fuel return passage 33. The opening/closing valve 9 (the second electromagnetic valve device) for controlling the fuel injection timing is connected to the middle of the fuel return passage 33. The opening/closing valve 9 is composed of, e.g., a two-way electromagnetic valve.

The fuel injection valve 8 has a needle valve 25 for opening and closing a nozzle 8*a* and a hydraulic piston 26, which is slidably contained in the pressure control chamber 21. The needle valve 25 is forced toward the nozzle 8*a* by a spring (not shown). If the fuel is supplied to the pressure control valve 21 and the fuel chamber 22 from the fuel passage 30 and the opening/closing valve 9 is closed, the resultant force from the spring force of the spring and the force generated by the fuel pressure in the pressure control chamber 21 is applied to the needle valve 25. The needle valve 25 closes the nozzle 8*a* against the force generated by the fuel pressure in the fuel chamber 22. When the opening/closing valve 9 is opened to thereby discharge the fuel in the pressure control chamber 21 toward the fuel tank 10 (in an atmosphere opening direction), the force generated by the fuel pressure in the fuel chamber 22 causes the needle valve 25 to move toward the hydraulic piston 26 against the spring force of the spring. This opens the nozzle 8. Then, the high-pressure fuel in the fuel chamber 22 is injected into a combustion chamber of the engine form the nozzle 8*a*.

There will now be described an example of the operation of the accumulator fuel injection system that is constructed in the above-mentioned manner.

Under the control of the electronic control unit 40, the fuel pressure in the high-pressure accumulation chamber 2, i.e., the discharge amount of the high-pressure fuel pump 1 conforms to the operating state of the engine, and a fuel injection period (a fuel injection start/finish timing) is determined according to the operating state of the engine (e.g., the revolutions of the engine and the depression amount of an accelerator pedal).

When both the switching valve 4 (the electromagnetic valve 12) and the opening/closing valve 9 are closed, the high-pressure fuel in the high-pressure accumulation chamber 2 is supplied to the pressure control chamber 17 through the inlet side orifice 13*d*. The high-pressure fuel in the pressure control chamber 17 presses up the needle valve 14. More specifically, the resultant force form the pressure and the spring force applied to the pressure control chamber 17 becomes larger than the force that presses up the needle valve 14 due to the fuel pressure in the high-pressure accumulation chamber 2 applied to the tip of the needle valve 14. Therefore, the needle valve 14 is pressed down to disconnect the inlet port 13*a* and the outlet port 13*b*.

The low-pressure fuel is supplied from the low-pressure accumulation chamber 3 to the fuel passage 30 at the downstream side of the switching valve 4. The low-pressure fuel supplied to the fuel passage 30 is further supplied to the pressure control chamber 21 and the fuel chamber 22 of the fuel injection valve 8. Since the opening/closing valve 9 is closed, the force generated by the fuel pressure supplied into the fuel control chamber 21 is applied to the needle valve 25 through the hydraulic piston 26, which closes the nozzle 8*a*.

If the opening/closing valve 9 is only opened in this state, the low-pressure fuel in the pressure control chamber 21 of the fuel injection valve 8 is discharged into the fuel tank 10 through the orifice 23 and the fuel return passage 33. Consequently, the needle valve 25 is lifted to open the nozzle 8*a* when the resultant force from the force generated by the fuel pressure applied to the needle valve 25 through the hydraulic piston 26 and the spring force of the spring becomes smaller than the pressure applied to the back face of the needle valve 14 in the pressure control chamber 17. Therefore, the low-pressure fuel is injected.

If the switching valve 4 for switching the injection rate is opened (the electromagnetic valve 12 is opened) in the state where the opening/closing valve 9 is opened, the high-pressure fuel in the pressure control chamber 17 is discharged from the fuel leak port 13*f* through the outlet side orifice 13*e*. Accordingly, the pressure in the pressure control chamber 17 is lowered. When the resultant force from the pressure applied to the back face of the needle valve 14 in the pressure control chamber 17 and the spring force of the spring becomes smaller than the force generated by the high fuel pressure applied to the tip of the needle valve 14, the needle valve 14 is pressed up and is opened to thereby connect the inlet port 13*a* with the outlet port 13*b*. Therefore, the high-pressure fuel in the high-pressure accumulation chamber 2 is supplied to the fuel chamber 22 of the fuel injection valve 8 to thereby inject the high-pressure fuel.

Figure 2:
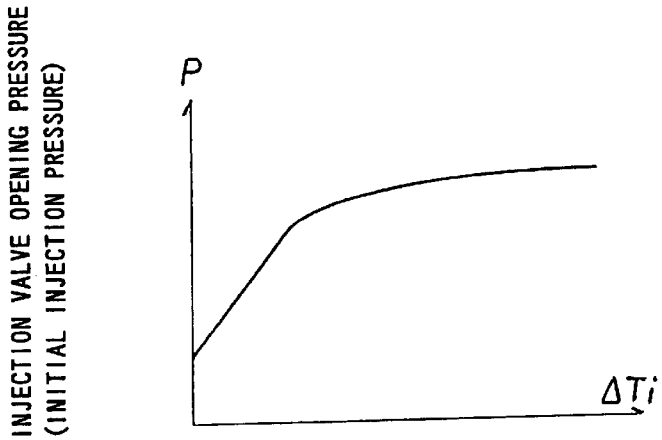
FIG. 2 is a view showing a relationship between a period from the opening of a low/high-pressure accumulation chamber switching valve to the opening of an opening/closing valve of an injection valve and an injection-valve opening pressure in the accumulator fuel injection system in FIG. 1.

Thus, the larger the injection amount of the low-pressure fuel, the longer is a period from the opening of the opening/closing valve 9 to the opening of the switching valve 4. If the switching valve 4 is opened prior to the opening of the opening/closing valve 9, the high-pressure fuel in the high-pressure accumulation chamber 2 is supplied to the fuel injection valve 8 before the nozzle 8*a* of the fuel injection valve 8 is opened. Thus, the initial injection pressure is high. The longer a period from the opening of the switching valve 4 to the opening of the opening and closing valve 9, the higher is the initial injection pressure. FIG. 2 shows a relationship between the period ΔTi from the switching valve 4 (the opening of the electromagnetic valve 12) to the opening/closing valve 9 of the fuel injection valve 8 and the fuel injection-valve opening pressure (the initial injection pressure). The longer the period ΔTi, the higher is the injection-valve opening pressure.

According to the present invention, the injection rate is controlled by using a pressure rise gradient of the injection-valve opening pressure according to the ΔTi from the opening of the switching valve 4 to the opening of the opening/closing valve 9.

FIG. 3 shows the examples of the change in the period ΔTi from the opening of the switching valve 4 to the opening of the opening/closing valve 9 and the injection rate waveform.

If the period ΔTi is short (the opening timing of the switching valve 4 is slightly or just before the opening timing of the switching valve 9) as shown in FIG. 3(A), the injection rate is a delta injection rate at which the injection amount starts increasing just after the start of the fuel injection. If the period ΔTi is long (the opening timing of the switching valve 4 is substantially before the opening timing of the switching valve 4) as shown in FIG. 3(B), the injection rate is nearly a rectangular injection rate at which the injection amount starts increasing sharply and a large amount of fuel is injected in a short period of time just after the start of the fuel injection. If the opening timing of the switching valve 4 is after the opening timing of the opening/closing valve 9 as shown in FIG. 3(C), the injection rate is a so-called boot injection rate at which a high-pressure injection follows a low-pressure initial injection.

The fuel pressure in the high-pressure accumulation chamber 2 controls an injection rate rise gradient and the maximum injection pressure. The fuel pressure is determined according to a fuel supply amount (discharge amount) of the high-pressure fuel pump 1. The fuel supply amount of the high-pressure fuel pump 1 is controlled by controlling a pumping stroke amount of a plunger by the electronic control unit 40 according to the operating state of the engine.

As indicated by dotter lines in FIG. 3, the injection rate is high when the fuel pressure in the high-pressure accumulation chamber 2 is high.

For example, if a fuel injection characteristic with a long fuel injection period since the engine is operated at a low speed and with a low load, the injection rate is the delta injection rate at which the injection amount starts increasing gradually just after the start of the fuel injection. If a fuel injection characteristic with a short fuel injection period since the engine is operated at a high speed and with a high load, the injection rate is the rectangular injection rate at which the injection amount starts increasing sharply to inject a large amount of fuel in a short period just after the start of the fuel injection. The maximum injection pressure is controlled according to the operating state of the engine. This raises the degree of freedom in the control of the injection rate to thereby achieve the optimum fuel injection rate according to the operating state of the engine. It is therefore possible to control the injection rate in an effective manner for the decrease in exhaust gas and the improvement of the fuel economy without losing the original merits of the accumulator fuel injection system.

To finish the fuel injection, the opening/closing valve 9 is closed as shown in FIG. 3, and the high-pressure fuel supplied to the pressure control chamber 21 from the fuel passage 30 through the orifice 20 is applied to the needle valve 25 through the hydraulic piston 26. The hydraulic piston 26 closes the nozzle 8*a* to finish the fuel injection. When the fuel injection is finished, the fuel injection rate is lowered sharply to reduce the amount of smoke and particulates (particulate matters PM) discharged from the engine.

The switching valve 4 for switching the injection rate is closed at the same time as the closing of the opening/closing valve 9 when the fuel injection is finished. Alternatively, the switching valve 4 is closed if a predetermined time has passed from the finish of the fuel injection.

Between the fuel chamber 22 of the fuel injection valve 8 and the switching valve 4 for switching the injection rate, the high-pressure fuel in the fuel passage 30 flows into the low-pressure accumulation chamber 3 through the orifice 7 in the branch passage 32. Consequently, the fuel pressure in the fuel passage 30 starts tapering when the fuel injection is finished in each fuel injection cycle. The fuel pressure is lowered so as to conform to the low-pressure injection set by the pressure control valve 5 before the start of the fuel injection in the next fuel injection cycle. This achieves a desired injection rate in the next low-pressure injection.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An accumulator fuel injection system comprising:

a first accumulation chamber for containing high-pressure fuel supplied by a fuel supply pump;

a first electromagnetic valve device provided in a fuel passage, which connects said first accumulation chamber with a fuel injection valve, said first electromagnetic valve switching said fuel passage between a connected state or a disconnected state;

a branch passage branched from said fuel passage at downstream side of said first electromagnetic device, said branch passage having sufficiently lower constant fuel pressure than fuel pressure in said first accumulation chamber;

a second electromagnetic valve device provided in a fuel return passage extending from said fuel injection valve to a fuel tank, said second electromagnetic valve device switching fuel, injected from said fuel injection valve, between an injected state and an uninjected state; and control means for opening said first electromagnetic valve device prior to opening of said second electromagnetic valve device and then opening said second electromagnetic valve device.

2. An accumulator fuel injection system according to claim 1, wherein:

said control means controls a period since said first electromagnetic valve device is opened until said second electromagnetic valve device is opened according to an operating state of an engine.

3. An accumulator fuel injection system according to claim 2, wherein:

said control means controls said period to a shorter period when an engine is operated at a low speed and with a low load.

4. An accumulator fuel injection system according to claim 2, wherein:

said control means controls said period to a longer period when an engine is operated at a high speed and with a high load.

5. An accumulator fuel injection system according to claim 1, wherein:

said control means controls said fuel supply pump to make variable fuel pressure in said first accumulation chamber according to an operating state of an engine.

6. An accumulator fuel injection system according to claim 1, wherein:

said branch passage has a second accumulation chamber provided in said branch passage, a pressure control valve provided in part opposite to said fuel passage with respect to said second accumulation chamber in said branch passage, and a check valve and an orifice provided in parallel in a part closer to said fuel passage than said second accumulation chamber in said branch passage; and said check valve only permits flow of the fuel from said second accumulation chamber toward said fuel passage.

* * * * *